US005730075A

United States Patent [19]

Moriguchi

[11] Patent Number: 5,730,075

[45] Date of Patent: Mar. 24, 1998

[54] AUTOMATIC LINKING METHOD

[75] Inventor: Saichiro Moriguchi, Kanazawa, Japan

[73] Assignee: Tsudakoma Kogyo Kabushiki Kaisha, Kanazawa, Japan

[21] Appl. No.: 614,342

[22] Filed: Mar. 12, 1996

[30] Foreign Application Priority Data

Mar. 13, 1995 [JP] Japan ..... 7-080671
Nov. 17, 1995 [JP] Japan ..... 7-323881

[51] Int. Cl.[6] ..... D05B 7/00

[52] U.S. Cl. ..... 112/27; 112/475.03

[58] Field of Search ..... 112/25, 27, 470.03, 112/470.07, 475.03, 26; 66/147, 148

[56] References Cited

U.S. PATENT DOCUMENTS 5,619,940 4/1997 Moriguchi ..... 112/27

*Primary Examiner*—Peter Nerbun
*Attorney, Agent, or Firm*—Wenderoth, Lind & Ponack

[57] ABSTRACT

An automatic linking method is carried out by an automatic linking apparatus having a simple construction. In the automatic linking apparatus, a plurality of needling positions are set in a needle moving mechanism having point needles that move along a path, and a fabric guide mechanism guides a first linking portion of a first knitted fabric and a linking portion of a second knitted fabric to the first needling position. The point needles are thrust in the first linking portion of the first knitted fabric and the linking portion of the second knitted fabric, the point needles are moved to move the first and the second fabric hooked thereon to the second needling position below the first needling position with respect to a direction in which the point needles are moved. The point needles are thrust sequentially into a second linking portion of the first knitted fabric so that the linking portion of the second knitted fabric is sandwiched between the first and the second linking portion of the first knitted fabric, and the superposed linking portions of the first and the second knitted fabric are stitched together by a sewing machine at a stitching position.

4 Claims, 16 Drawing Sheets

AUTOMATIC LINKING METHOD

BACKGROUND OF THE INVENTION

1. Field of the Invention

The present invention relates to an automatic linking method capable of being carried out by an automatic linking apparatus having a simple construction.

2. Description of the Related Art

An automatic linking apparatus disclosed in JP-B No. 3-49478 has point needles arranged in two rows to link up two knitted fabrics using an automatic linking operation. When linking up two knitted fabrics by using this prior art automatic linking apparatus, stitches on a linking line on each knitted fabric are guided to a needling position set for each row of the point needles by a fabric guide unit provided with an image processing device, the point needles are thrust into the stitches on the linking line on the knitted fabrics sequentially, the two rows of the point needles are moved in a direction in which the rows of the point needles are extended, one of the knitted fabrics on the point needles of one of the two rows is transferred to the point needles of the other row, and then the two knitted fabrics are stitched together along the linking lines by a sewing machine. The automatic linking apparatus is provided with a needle moving unit comprising point needles arranged in rows respectively corresponding to linking lines (two linking lines) on knitted fabrics to be linked up, and needle moving devices respectively corresponding to the rows of the point needles. Accordingly, this automatic linking apparatus has a complex construction.

SUMMARY OF THE INVENTION

Accordingly, it is an object of the present invention to enable an automatic linking apparatus having a simple construction to carry out an automatic linking operation.

With the foregoing object in view, the present invention provides an automatic linking method that thrusts point needles into stitches on linking lines on a plurality of knitted fabrics to be linked up, superposes the knitted fabrics and stitches the knitted fabrics together. The method comprises the steps of guiding stitches on a first linking line on a first knitted fabric to a first needling position by a fabric guide means while monitoring the position of the first knitted fabric, thrusting the point needles sequentially into the stitches on the first linking line on the first fabric, moving the point needles in parallel to the row of the point needles, guiding stitches on a second linking line on a second knitted fabric to a second needling position below the first needling position with respect to the direction of movement of the point needles by a fabric guide means while monitoring the position of the second knitted fabric, thrusting the point needles over which the first knitted fabric is hooked sequentially into the stitches on the second linking line on the second fabric, moving the point needles to a stitching position below the second needling position, and stitching together the first and the second knitted fabric using a sewing machine.

Whereas the prior art knitted fabric linking method requires an automatic linking apparatus provided with a needle moving means having rows of point needles each having one needling position, the number of the rows of the point needles being equal to the number of the knitted fabric to be linked up, e.g., two rows of point needles for linking up two knitted fabrics, the automatic linking method of the present invention requires an automatic linking apparatus provided with a single row of point needles for a plurality of knitted fabrics to be linked up because the point needles arranged in a single row are thrust into stitches on the first and the second linking lines on the first and the second knitted fabrics at the different needling positions, respectively. Accordingly, the automatic linking apparatus for carrying out the automatic linking method is simpler in construction than that for carrying out the prior art knitted fabric linking method.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

First Embodiment

Figure 1:
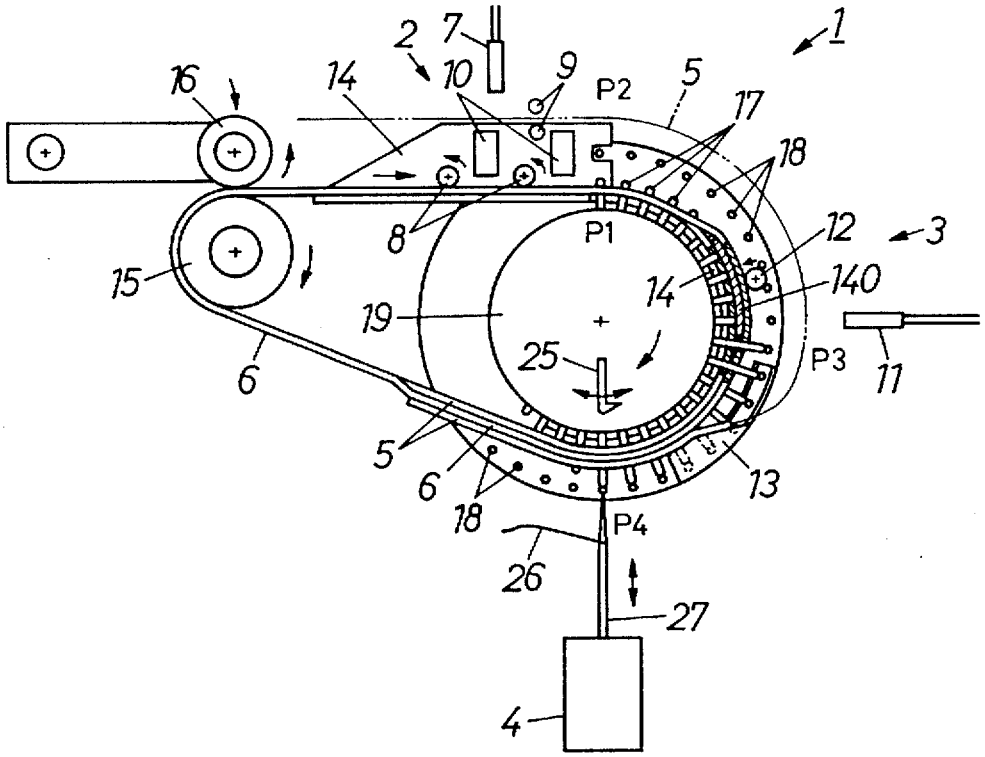
FIG. 1 is a schematic front view of an automatic linking apparatus for carrying out an automatic linking method in a first embodiment according to the present invention.

An automatic linking method in a first embodiment according to the present invention is carried out by an automatic linking apparatus 1 shown in FIGS. 1 to 8. The automatic linking apparatus 1 carries out a sandwich linking operation for sandwiching a second knitted fabric 6 between portions of a first knitted fabric 5 and linking the first knitted fabric 5 and the second knitted fabric 6. Referring to FIGS. 1 to 7, the automatic linking apparatus 1 comprises a fabric guide unit 2, a point needle moving unit 3 and a sewing machine 4. The first knitted fabric 5, such as a collar, i.e., a rectangular accessory part, has two longer edge portions to be linked to the second knitted fabric 6, i.e., a first and a second edge portion. The second knitted fabric 6, such as a body part having a neckline, has an endless edge portion forming the neckline to be linked to the first knitted fabric 5. The opposite shorter edges of the first knitted fabric 5 may be sewn together to form the first knitted fabric in a ring-like shape and the first knitted fabric 5 having a ring-like shape may be set on the automatic linking apparatus 1.

The fabric guide unit 2 guides the first and the second edge portion of the first knitted fabric 5 to a first needling position P1 and a second needling position P2, respectively, and guides the edge portion of the second knitted fabric 6 to a third needling position P3. The fabric guide unit 2 comprises first, second and third fabric guide devices. The first fabric guide device guides the first edge portion of the first knitted fabric 5, is disposed above the first needling position P1 with respect to the direction in which the first knitted fabric 5 is fed, and comprises a pair of edge sensors 7 and two rollers 8. The second fabric guide device guides the second edge portion of the first knitted fabric 5, is disposed above the second needling position P2 and comprises a pair of edge sensors 9 and two rollers 10. The third fabric guide device guides the edge portion of the second knitted fabric 6, such as a body part, is disposed above the third needling position P3, and comprises a pair of edge sensors 11, a roller 12 and a guide plate 13 serving as a stitch transfer means.

Figure 2:
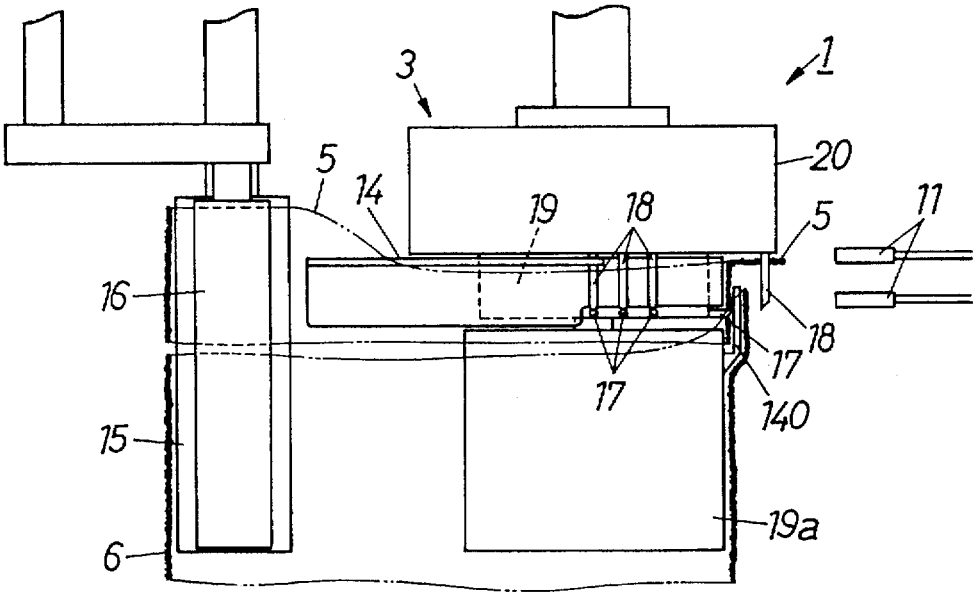
FIG. 2 is a schematic plan view of the automatic linking apparatus of FIG. 1.
Figure 3:
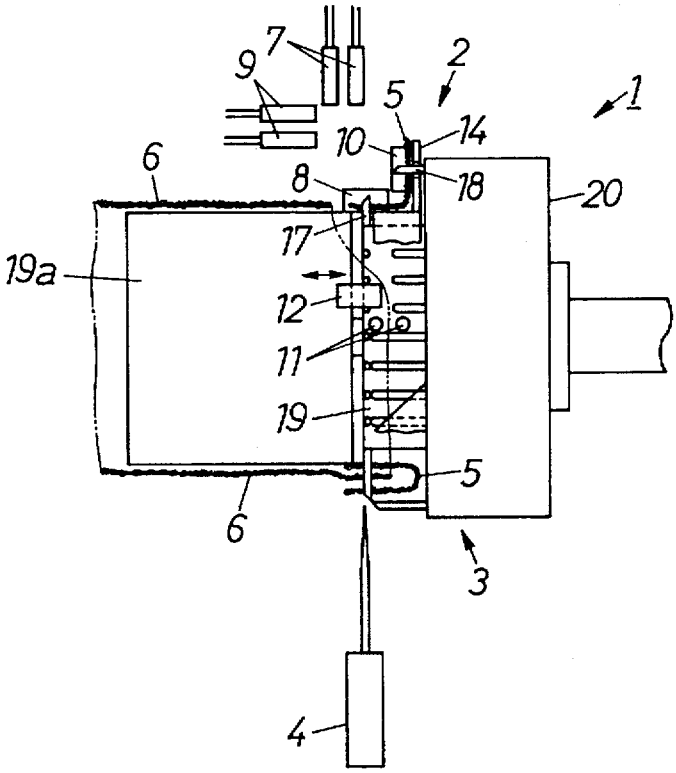
FIG. 3 is a schematic side view of the automatic linking apparatus of FIG. 1.

The edge sensors 7 and 9, and the rollers 8 and 10 are disposed opposite to the horizontal and the vertical wall, respectively, of a table 14 having an L-shaped cross section. The vertical wall of the table 14 extends to the second needling position P2 as shown in FIG. 1. As shown in FIG. 2, the width of a rear portion of the horizontal wall of the table 14 extending beyond the first needling position P1 is reduced, and the rear portion of the horizontal wall of the table 14 extends through a space between a row of first point needles 17 and the front end surface of a second drum 20 over a range from the first needling position P1 through more than half the circumference of a first drum 19. As shown in FIGS. 1 and 2, a curved guide 140 having the shape of a circular arc is disposed above the third needling position P3. The curved guide 140 is attached to a fixed cover 19*a*. The curved guide 140 is disposed so that a portion corresponding to the first needling position P1 extends above the tip of the first point needle 17 raised at the first needling position P1. The fabric sensors 11 and the roller 12 are disposed opposite to the outer surface of the curved guide 140.

The guide plate 13 guides the portion of the first knitted fabric 5 hooked on second point needles 18 toward the horizontal wall of the table 14 to fold the first knitted fabric 5 in a U-shaped cross section so that the edge portion of the second knitted fabric 6 is sandwiched between the edge portions of the first knitted fabric 5. The guide plate 13 is disposed below the third needling position P3 and above the sewing machine 4. The second knitted fabric 6 is fed through the nip between a feed roller 15 and a pressure roller 16 and along the outer surface of the curved guide 140 to the third needling position P3.

The point needle moving unit 3 has the first drum 19, i.e., a first needle moving member, holding the first point needles 17 in a circular arrangement at equal angular intervals so that the first point needles 17 project radially from its circumference, and the second drum 20, i.e., a second needle moving member, holding the second point needles 18 in a circular arrangement at equal angular intervals so that the second point needles 18 project from its front end surface perpendicularly to the first point needles 17. The first drum 19 is formed integrally with the second drum 20 on the front end surface of the latter. The first point needles 17 travel through the first needling position P1 and the third needling position P3 as the first drum 19 rotates. The second point needles 18 travel through the second needling position P2 as the second drum 20 rotates. The point needle moving unit 3 raises the first point needles 17 sequentially at the first needling position P1 to thrust the first point needles 17 into one of the edge portions of the first knitted fabric 5, raises the second point needles 18 sequentially at the second needling position P2 to thrust the second point needles 18 into the other edge portion of the first knitted fabric 5, further raises the first point needles 17 at the third needling position P3 to thrust the first point needles 17 into the edge portion of the second knitted fabric 6, and moves the first knitted fabric 5 and the second knitted fabric 6 to a stitching position P4.

Figure 4:
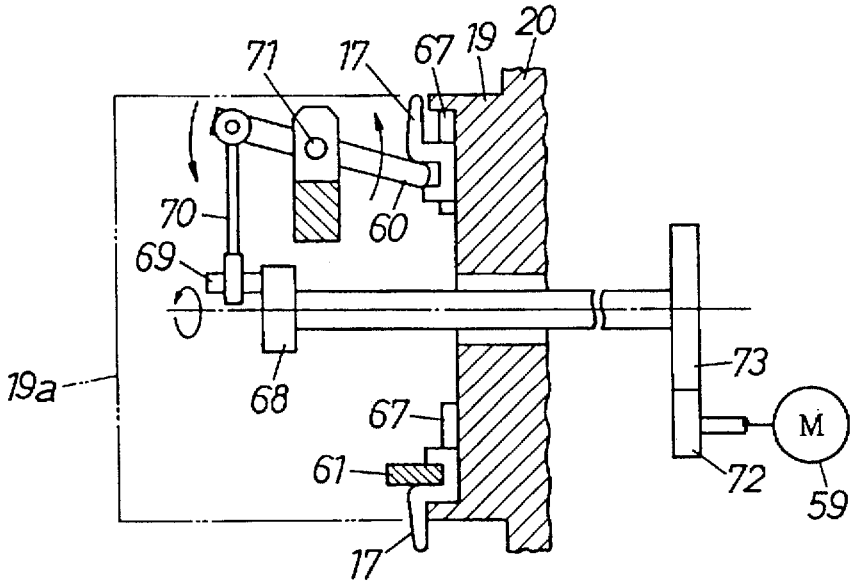
FIG. 4 is a schematic side view of a first point needle driving mechanism included in the automatic linking apparatus of FIG. 1.
Figure 5:
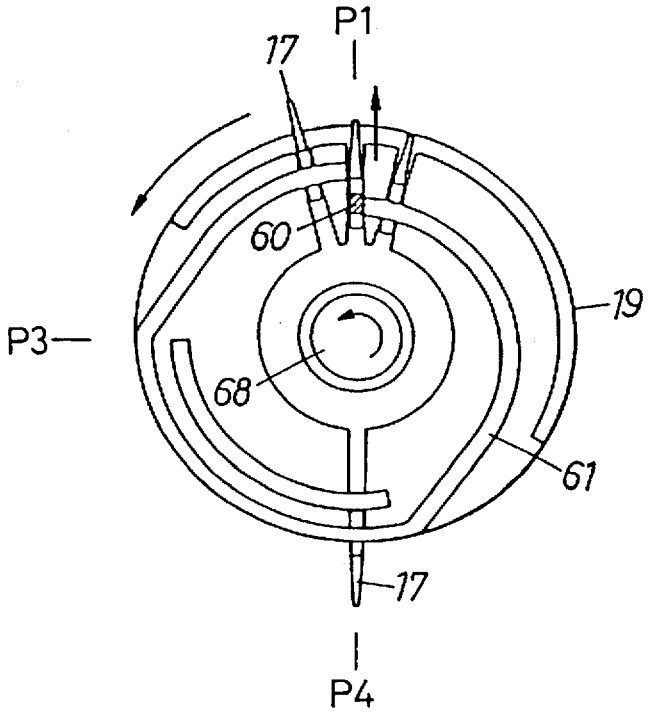
FIG. 5 is a schematic front view of a cam for moving first point needles included in the automatic linking apparatus of FIG. 1.
Figure 6:
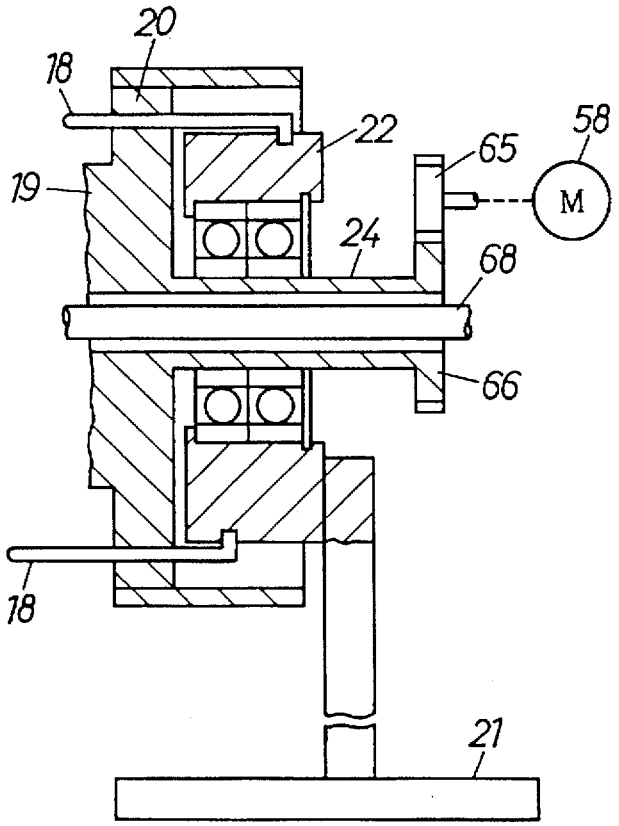
FIG. 6 is a schematic sectional view of a second point needle driving mechanism included in the automatic linking apparatus of FIG. 1.
Figure 7:
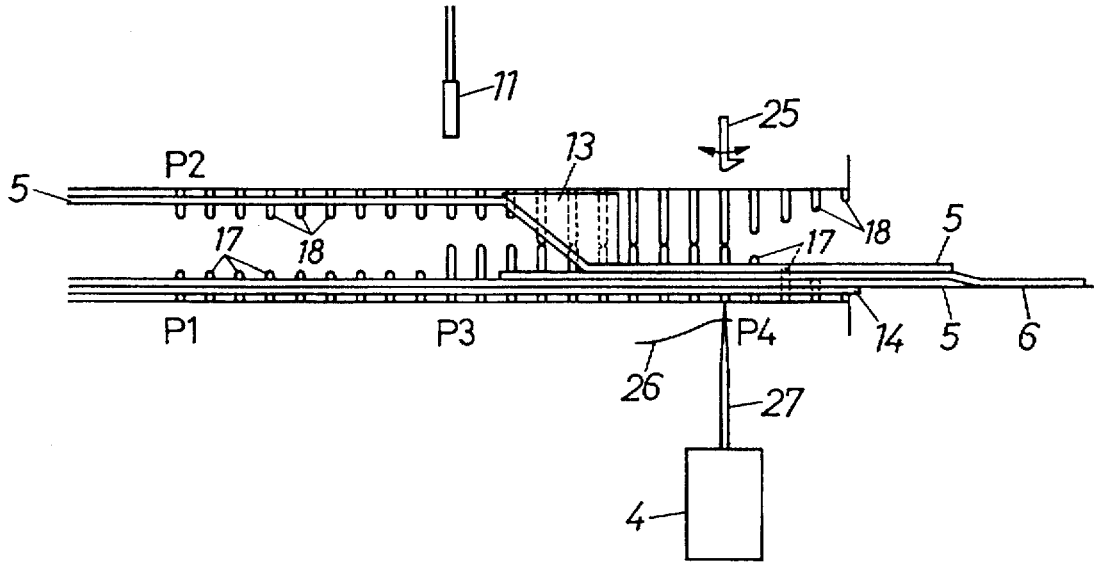
FIG. 7 is a development of first and second point needles.

The first point needles 17 are raised in two steps at the first needling position P1 and the third needling position P3, respectively, and are lowered to a retracted position after passing the stitching position P4 by a groove cam and a needle raising device contained in the first drum 19. As shown in FIGS. 4, 5 and 6, a hollow shaft 24 fixedly connected to or formed integrally with the integral assembly of the first drum 19 and the second drum 20 is supported for rotation in bearings on a groove cam 22 which in turn supported on a fixed frame 21. The hollow shaft 24 is driven for rotation at a given rotating speed through gears 65 and 66 by a motor 58. The first drum 19 is provided with a plurality of radial needle grooves 67 arranged at equal angular pitches, and the first point needles 17 are slidably fitted in the radial needle grooves 67, respectively, and are moved radially by a fixed cam 61 as the first drum 19 rotates. The fixed cam 61 is formed so as to further raise the first point needles 17 raised to a first working position at the first needling position P1 by a needle raising member 60 to a second working position at the third needling position P3, and to retract the first point needles 17 to a retracted position after the point needles 17 have passed the stitching position P4. The needle raising member 60 is supported pivotally on a pin 71 and is connected to a crankpin 69 by a connecting rod 70.

A drive shaft 68 is extended coaxially through and supported in bearings, not shown, on the hollow shaft 24 and is driven for rotation through gears 72 and 73 by a motor 59 as shown in FIG. 4. The needle raising member 60 is driven through the drive shaft 68, the crankpin 69 and the connecting rod 70 by the motor 59 to raise the first point needles 17 to the first working position upon the arrival of the first point needles 17 from the retracted position at the first needling point P1 to thrust the first point needles 17 into the first knitted fabric 5. The needle raising member 60 may be driven by directly driving the connecting rod 70 for vertical movement by an actuator, such as a solenoid actuator.

As shown in FIG. 6, the second point needles 18 are supported axially slidably on the second drum 20. The groove cam 22 raises the second point needles 18 at the second needling position P2 and retracts the same to a retracted position after the same has passed the stitching position P4. Since the second drum 20 is formed integrally with the first drum 20, the former is supported for rotation at a given rotating speed in the fabric feed direction by the hollow shaft 24 on the frame 21 by the motor 58.

The sewing machine 4 is disposed at the stitching position P4 and advances a needle 27 toward the center of the first drum 19 to stitch together the first knitted fabric 5 and the second knitted fabric 6 with a thread 26 in cooperation with a looper 25 disposed behind the first drum 19.

When linking up the endless first knitted fabric 5 and the endless second knitted fabric 6 with the edge portion of the second knitted fabric 6 sandwiched between the opposite edge portions of the first knitted fabric 5, the first knitted fabric 5 is bent in an L-shape so as to lie on the vertical and the horizontal wall of the table 14, the first knitted fabric 5 and the second knitted fabric 6 are wound around the feed roller 15 and the first drum 19, and then the respective first stitches of the edge portions of the first knitted fabric 5 and the second knitted fabric 6 are hooked on the corresponding point needles at the needling positions P1, P2 and P3, respectively, in the aforesaid manner. Then, the automatic linking apparatus 1 is started to feed the knitted fabrics 5 and 6 in the direction of the arrow shown in FIG. 1. The first fabric guide device positions the first edge portion of the first knitted fabric 5 and guides the same to the first needling position P1.

The first fabric guide device holds the first edge portion of the first knitted fabric 5 between the horizontal wall of the table 14 and the rollers 8, and adjusts the axial positions of the rollers 8 according to fabric detection signals provided by the pair of edge sensors 7 to position the edge of the first edge portion of the first fabric 5 at a position corresponding to a position between the pair of edge sensors 7. The rollers 8 may be positively driven or may be dragged for rotation by the first knitted fabric. Simultaneously with the guiding action of the first fabric guide device, the second fabric guide device adjusts the axial positions of the rollers 10 according to fabric detection signals provided by the pair of edge sensors 9 to position the edge of the second edge portion of the first knitted fabric 5 at a position corresponding to a position between the pair of edge sensors 9, and guides the second edge portion of the first knitted fabric 5 to the second needling position P2. Thus, the first and the second edge portion of the first knitted fabric 5 are guided correctly to the first needling position P1 and the second needling position P2, respectively.

The first point needles 17 and the second point needles 18 are raised and thrust into the first and the second edge portion of the first knitted fabric 5 at the first needling position P1 and the second needling position P2, respectively. As the drums 19 and 20 rotate synchronously, the first fabric 5 moves in the feed direction. The first edge portion of the first knitted fabric 5 hooked on the first point needles 17 moves along the inner surface of the curved guide 140. A rotary driving member, not shown, connected to the feed roller 15 rotates in synchronism with the drums 19 and 20 so that the first knitted fabric 5 and the second knitted fabric 6 move in synchronism with the movement of the point needles 17 and 18.

The second knitted fabric 6 is spaced apart in the direction of the axis of the first drum 19 from the first point needles 17 in the vicinity of the first needling position P1. Since the second knitted fabric 6 is held between the curved guide 140 and the roller 12, the edge portion of the second knitted fabric 6 is guided toward a position above the first point needles 17 as the same moves along the curved guide 140. The edge sensors 11 detect the edge of the edge portion of the second knitted fabric 6, the axial position of the roller 12 is adjusted according to fabric detection signals provided by the edge sensors 11 to position the edge portion of the second knitted fabric 6 at the third needling position P3. The first point needles 17 are raised further and thrust into the edge portion of the second knitted fabric 6 at the third needling position P3. In a range below the third needling position P3, the first edge portion of the first knitted fabric 5 and the edge portion of the second knitted fabric 6 are hooked on the first point needles 17, and the first point needles 17 come point to point with the second point needles 18, respectively.

As the first knitted fabric 5 and the second knitted fabric 6 hooked on the point needles 17 and 18 move toward the stitching position P4, the second edge portion of the first knitted fabric 5 is moved toward and transferred to the first point needles 17 by the guide plate 13, so that the edge portion of the second knitted fabric 6 is sandwiched between the first and the second edge portion of the first knitted fabric 5 on the first point needles 17 before the edge portions of the first knitted fabric 5 and the edge portion of the second knitted fabric 6 arrive at the stitching position P4. As shown in a development in FIG. 7, the guide plate 13 has two inclined surfaces parallel to the first point needles 17 and the second point needles 18 and inclined at predetermined angles to the axes of the first point needles 17 and the second point needles 18, respectively.

As the second edge portion of the first knitted fabric hooked on the second point needles 18 move toward the stitching position P4, one of the inclined surfaces of the guide plate 13 shifts the second edge portion of the first knitted fabric gradually toward the tips of the second point needles 18, and then the other inclined surface of the guide plate 13 transfers the second edge portion of the first knitted fabric 5 from the second point needles to the first point needles 17. The needle 27 and the looper 25 of the sewing machine cooperate to stitch together the first knitted fabric 5 and the second knitted fabric 6 with the thread 26.

Figure 8:
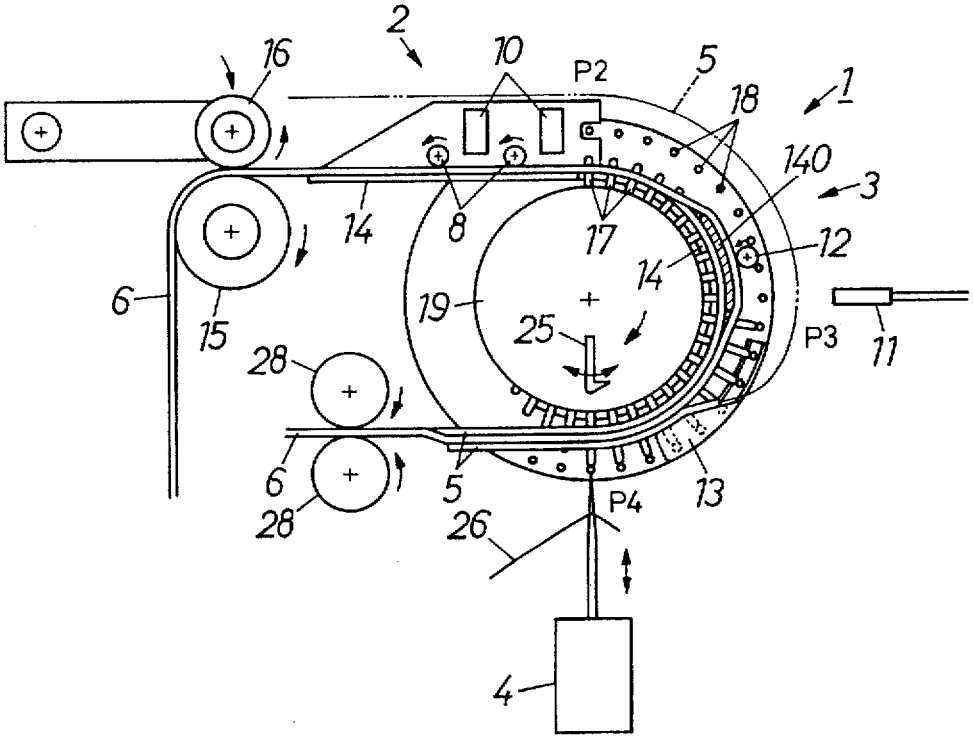
FIG. 8 is a front view of a modification of the automatic linking apparatus of FIG. 1.

When the edge portion of the second knitted fabric is not endless and the opposite shorter edges of the first knitted fabric 5 are not stitched together, the first knitted fabric 5 and the second knitted fabric 6 are pulled by a pair of delivery rollers 26 as shown in FIG. 8 after the same have been stitched together. In a modification, the guide plate 13 maybe formed so as to transfer the first edge portion of the first knitted fabric 5 and the edge portion of the second knitted fabric 6 from the first point needles 17 to the second point needles 18, and the first and the second edge portions of the first knitted fabric 5 and the edge portion of the second knitted fabric hooked on the second point needles may be stitched by the sewing machine 4. In this modification, the plurality of needling positions are set on the path of point needles on one row, and the first knitted fabric 5 and the second knitted fabric 6 are hooked on and moved to a stitching position by point needles on point needles on another row. Such a modification falls within the scope of the present invention.

A transfer means other than the guide plate 13, such as air nozzles or brushes, may be used for transferring the knitted fabrics from the second point needles 18 to the first point needles 17 or vice versa. More concretely, a pair of air nozzles or a pair of moving brushes maybe used to move the second edge portion of the first knitted fabric 5 hooked on the second point needles 18 toward the tips of the second point needles 18 by jetting air through one of the pair of air nozzles or by moving one of the moving brushes toward the tip of the second point needles 18, and to transfer the second edge portion of the first knitted fabric 5 from the second point needles 18 to the first point needles 17 by jetting air through the other air nozzle or by moving the other moving brush.

A single edge sensor maybe used instead of each of the pairs of edge sensors 7, 9 and 11. When a single sensor is used instead of each of the pairs of edge sensors 7, 9 and 11, positions of the rollers 8, 10 and 12 are adjusted so that the edges of the edge portions of the knitted fabrics are within the respective predetermined detection range of the edge sensors. Linking marks may be formed along the linking lines on the edge portions of the knitted fabric with a colored yarn (waste courses) and the positions of the rollers 8, 10 and 12 may be adjusted so that the linking marks are detected by the edge sensors.

When setting the first knitted fabric 5 and the second knitted fabric 6 on the automatic linking apparatus 1 with the corresponding portions thereof to be linked up coinciding with each other, the automatic linking apparatus 1 is started with only the first knitted fabric 5 set on the automatic linking apparatus 1, the automatic linking apparatus 1 is stopped upon the detection of arrival of the foremost first point needle 17 among the first point needles 17 on which the first knitted fabric 5 is hooked at the third needling position P3 by a fabric detector or the like, a portion of the second knitted fabric 6 corresponding to a portion of the first knitted fabric 5 hooked on the foremost first point needle 17 itself is hooked on the foremost first point needle 17, and then the rest of the portions of the second knitted fabric 6 are hooked on the successive first point needles 17.

Second Embodiment

Figure 9:
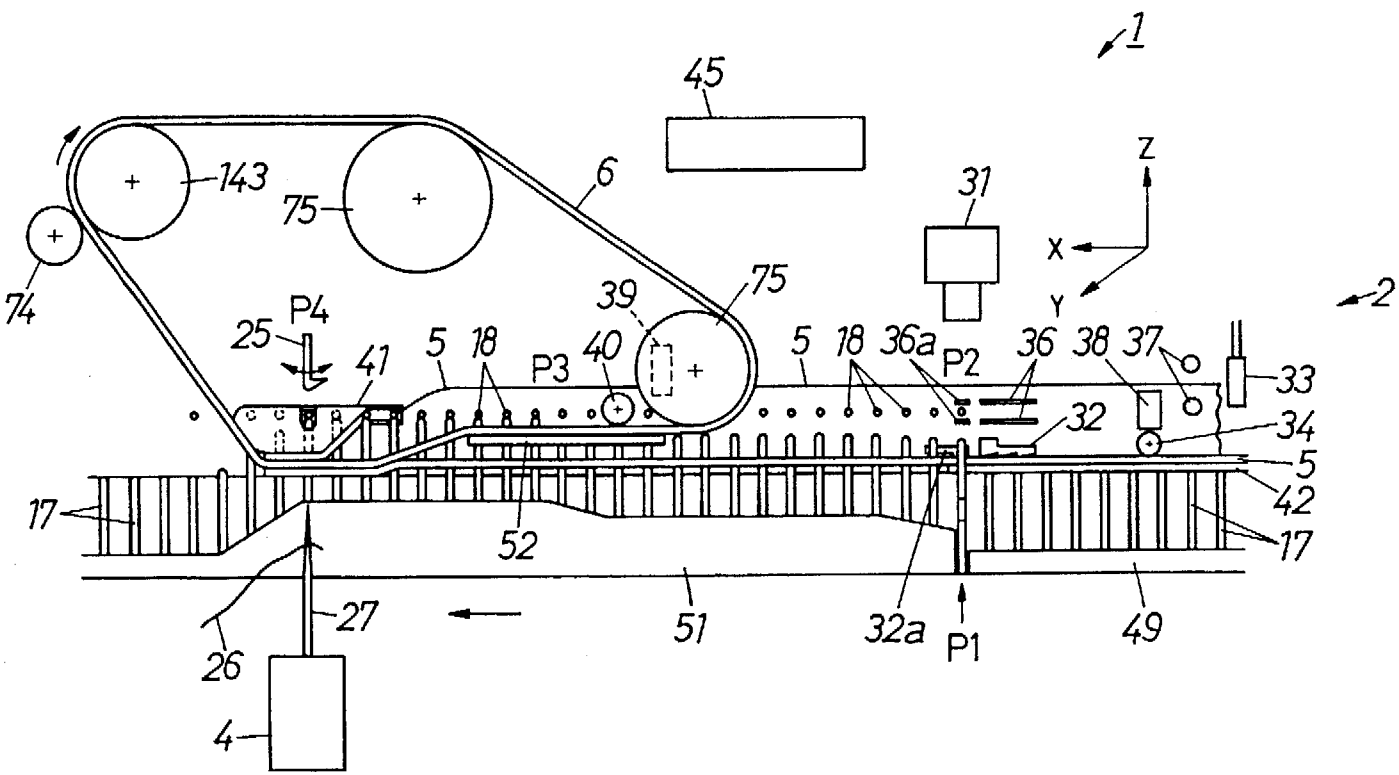
FIG. 9 is a schematic front view of an automatic linking apparatus for carrying out an automatic linking method in a second embodiment according to the present invention.
Figure 10:
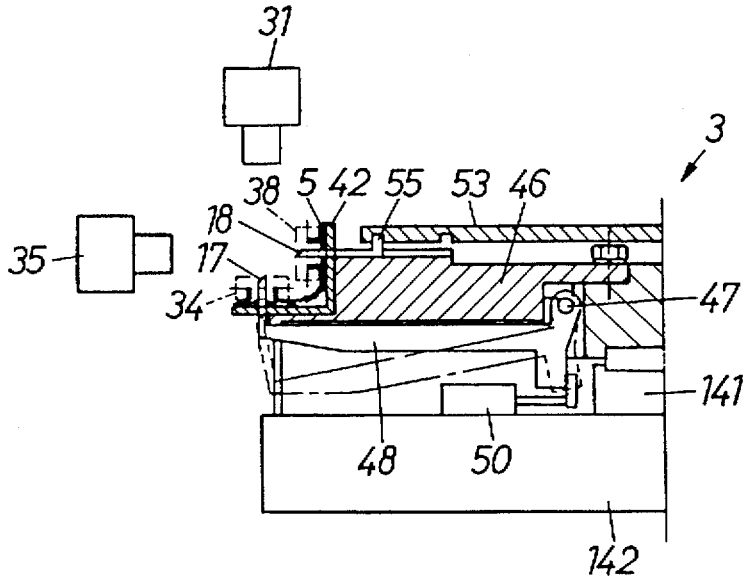
FIG. 10 is a schematic sectional view of a principal portion of the automatic linking apparatus of FIG. 9.

An automatic linking method in a second embodiment according to the present invention is carried out by an automatic linking apparatus 1 shown in FIGS. 9 to 10. Referring to FIGS. 9 and 10, a point needle moving unit 3 has first point needles 17 and second point needles 18 arranged in two straight rows, respectively. A first needling position P1 and a third needling position P3 are set on the path of the first point needles 17, and a second needling position P2 is set on the path of the second point needles 18.

A fabric guide unit 2 has first, second and third fabric guide devices disposed at the needling positions P1, P2 and P3, respectively. The first fabric guide device for guiding a first edge portion of the first knitted fabric 5 to the first needling position P1 comprises an image processing camera 31, a pair of hands 32, a pair of auxiliary hands **32*a*, a pair of edge sensors 33 and a positioning roller 34. The second fabric guide device for guiding a second edge portion of the first knitted the fabric 5 to the second needling position P2 comprises a camera 35, a pair of hands 36, a pair of auxiliary hands 36*a*, a pair of edge sensors 37 and a positioning roller 38. The third fabric guide device for guiding an edge portion of the second knitted fabric 6 to the third needling position P3 comprises a pair of edge sensors 39 and a roller 40. A guide plate 41, i.e., a transfer plate cam, is disposed at a stitching position P4 to transfer the second edge portion of the first knitted fabric hooked on the second point needles 18 to the first point needles 17**.

As shown in FIGS. 9 to 16, the first knitted fabric 5 is bent in an L-shape so as to lie on the vertical and the horizontal wall of a table 42 having an L-shaped cross section, and the first and the second edge portion of the first knitted fabric 5 are positioned by the agency of the pair of edge sensors 33 and the positioning roller 34 disposed in combination with the horizontal wall of the table 42 and the agency of the pair of edge sensors 37 and the positioning roller 38 disposed in combination with the vertical wall of the table 42, respectively. Then, the edge portions of the first knitted fabric 5 are positioned at the needling positions P1 and P2 for hooking up by the cooperative operations of the pairs of hands 32 and 36, the pairs of auxiliary hands **32*a* and 36*a*, the cameras 31 and 35, and an image processing device 45**, respectively.

The fabric guiding operations of the pairs of hands 32 and 36, and the pairs of auxiliary hands **32*a* and 36*a* will be described. The pair of hands 32 and the pair of auxiliary hands 32*a*, and the pair of hands 36 and the pair of auxiliary hands 36*a* can be moved toward and away from each other, and can be moved vertically, forward and backward (in directions parallel to the fabric feed direction) and transversely (in directions perpendicular to the fabric feed direction) by actuators, not shown. At the initial stage of the fabric guiding operation, the pairs of hands 32 and 36, and the pairs of auxiliary hands 32*a* and 36*a* are lowered to press the edge portions of the knitted fabric detected by the cameras 31 and 35, the pair of hands 32 and the pair of auxiliary hands 32*a*, and the pair of hands 36 and the pair of auxiliary hands 36*a*** are moved away from each other to expand the stitches of the knitted fabric, move forward with the knitted fabric held therebetween according to information about the positions of the stitches to be needled, and then move transversely to position the stitches to be needled at the needling position.

Then, the pairs of auxiliary hands **32*a* and 36*a* are raised and separated from the first knitted fabric 5 and moved forward beyond positions shown in FIG. 9 to standby positions where the pairs of auxiliary hands 32*a* and 36*a* will not interfere with the pairs of hands 32 and 36, respectively. Upon the arrival of the stitches to be needled of the first knitted fabric 5 held by the pairs of hands 32 and 36 spaced apart from each other at the needling positions P1 and P2, respectively, the pairs of auxiliary hands 32***a* and 36*a* are moved backward to positions opposite to the pairs of the hands 32 and 36 with respect to the needling positions P1 and P2, respectively, as shown in FIG. 9, and are lowered to press and hold the first knitted fabric 5 in place. Since the distances between the pairs of auxiliary hands 32*a* and 36*a* are determined so that the pairs of auxiliary hands 32*a* and 36*a* can enter the spaces between the pairs of hands 32 and 36, respectively, the pairs of auxiliary hands 32*a* and 36*a* will not interfere with the pairs of hands 32 and 36, respectively. Then, the pairs of hands 32 and 36 are raised to release the first knitted fabric 5. In this state, the first point needles 17 and the second point needles 18 are raised by needle raising devices 50 and 56, respectively, to thrust the raised first point needles 17 and the raised second point needles 18 into the first knitted fabric 5. Then, the pairs of hands 32 and 36 are moved backward with respect to each other and lowered, and the pairs of auxiliary hands 32*a* and 36*a* are raised and moved forward to the standby positions, respectively.

The first point needles 17 are set in a position perpendicular to the horizontal wall of the table 42, and are fastened to the extremities of levers 48 supported by horizontal pins 47 on a holder 46. The holder 46 is supported on a linear bearing 141 for sliding movement on a base 142. The levers 48 are arranged at equal predetermined intervals with their back ends received in grooves formed at equal intervals in portions of the holder 46 corresponding to the pins 47.

The first point needles 17 slide along the upper surface of a guide plate 49 as the holder 46 moves in the fabric feed direction to the first needling position P1, and are raised at the first needling position P1 by the needle raising device 50 so as to project from the table 42 into the first edge portion of the first knitted fabric 5 lying on the horizontal wall of the table 42. Then, the first point needles 17 are advanced along the surface of a lower cam section of a fixed cam 51 with the points thereof maintained at a fixed height. The first point needles 17 ride on the surface of a high cam section of the fixed cam 51 at the third needling position P3 so that the first point needles 17 are thrust into the second knitted fabric 6. Portions of the horizontal and the vertical wall of the L-shaped table 42 extending forward beyond the first needling position P1 and the second needling position P2, respectively, to the stitching position P4 are bifurcated into pairs of portions so that the pairs of portions of the horizontal and the vertical wall of the table 42 extend on the opposite sides of the rows of the first point needles 17 and the second point needles 18, respectively.

Figure 11:
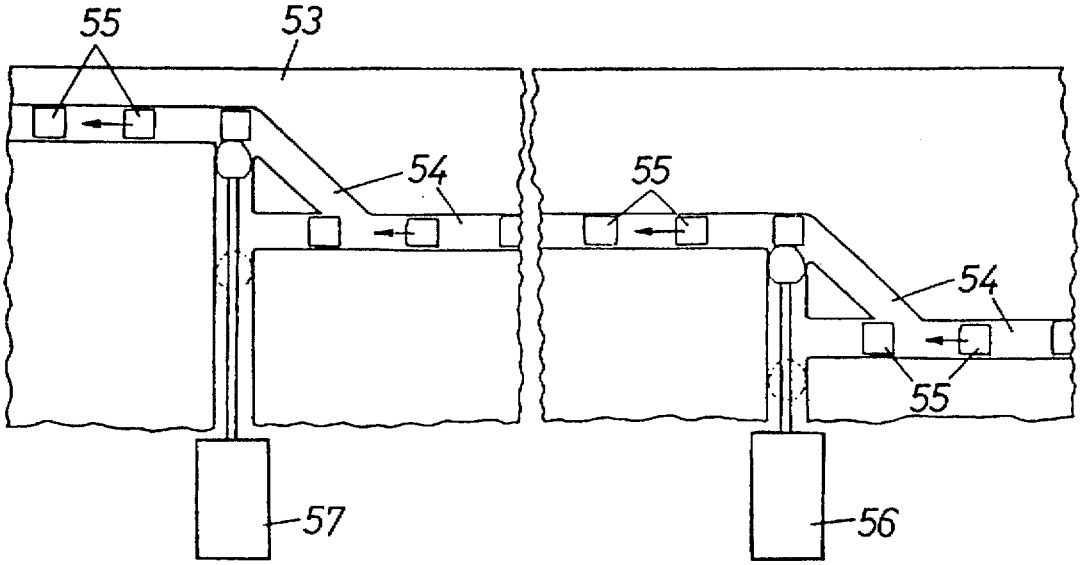
FIG. 11 is a schematic plan view of a second point needle driving cam included in the automatic linking apparatus of FIG. 9.
Figure 12:
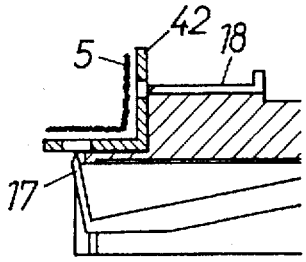
FIG. 12 is a diagrammatic view showing the positional relation between first and second point needles on the automatic linking apparatus of FIG. 9.
Figure 13:
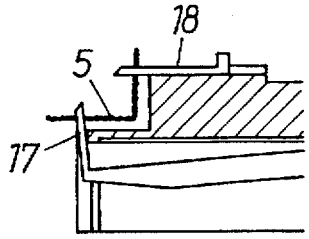
FIG. 13 is a fragmentary sectional view showing a first knitted fabric hooked on first and second point needles on the automatic linking apparatus of FIG. 9.

The second point needles 18 are arranged at predetermined pitches and set in a horizontal position in a plurality of grooves formed at predetermined intervals formed in the upper surface of the holder 46, and butts 55 formed integrally with the back portions of the second point needles 18 are engaged with a cam groove 54 formed in a fixed plate cam 53 as shown in FIG. 11. Accordingly, when the holder 46 moves in the fabric feed direction, the second point needles 18 are raised in two steps by needle raising devices 56 and 57 so as to project from the vertical wall of the table 42 into the expanded stitches of the first knitted fabric 5 at the second needling position P2. Thus, the first knitted fabric 5 is bent in an L-shape along the surface of the table 42, and the first knitted fabric 5 thus stretched for needling and hooked on the vertical first point needles 17 and the horizontal second point needles 18 is transported to the stitching position P4.

The second knitted fabric 6 is guided by a feed roller 143, a pressure roller 74 and a plurality of guide rollers 75, is positioned on a flat guide table 52 by the agency of a pair of edge sensors 39 and a roller 40, is hooked on the first point needles 17 at the third needling position P3, and is transported to the stitching position P4. The axial position of the roller 40 is adjusted according to edge detection signals provided by the pair of edge sensors 39 so that the edge of the second knitted fabric 6 is positioned at a position corresponding to a position between the pair of edge sensors 39. The stitches of the second edge portion of the first knitted fabric 5 on the vertical wall of the table 42 are transferred sequentially from the second point needles 18 to the first point needles 17 by an L-shaped transfer guide plate 41 so as to be placed over the upper surface of the second knitted fabric 6. In this state, the first knitted fabric 5 and the second knitted fabric 6 are stitched together with a thread 26 by a sewing machine 4.

Figure 14:
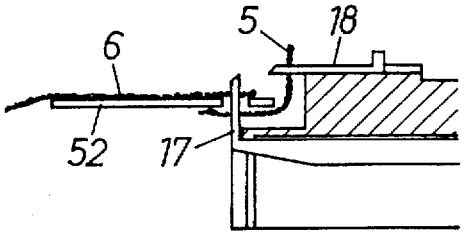
FIG. 14 is a fragmentary sectional view showing the first knitted fabric and a second knitted fabric hooked on the first point needles on the automatic linking apparatus of FIG. 9.
Figure 15:
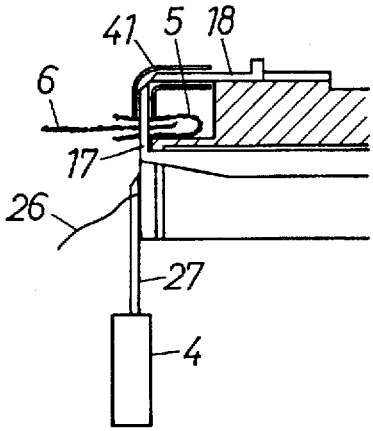
FIG. 15 is a fragmentary sectional view showing the first knitted fabric transferred from the second point needles to the first point needles on the automatic linking apparatus of FIG. 9.
Figure 16:
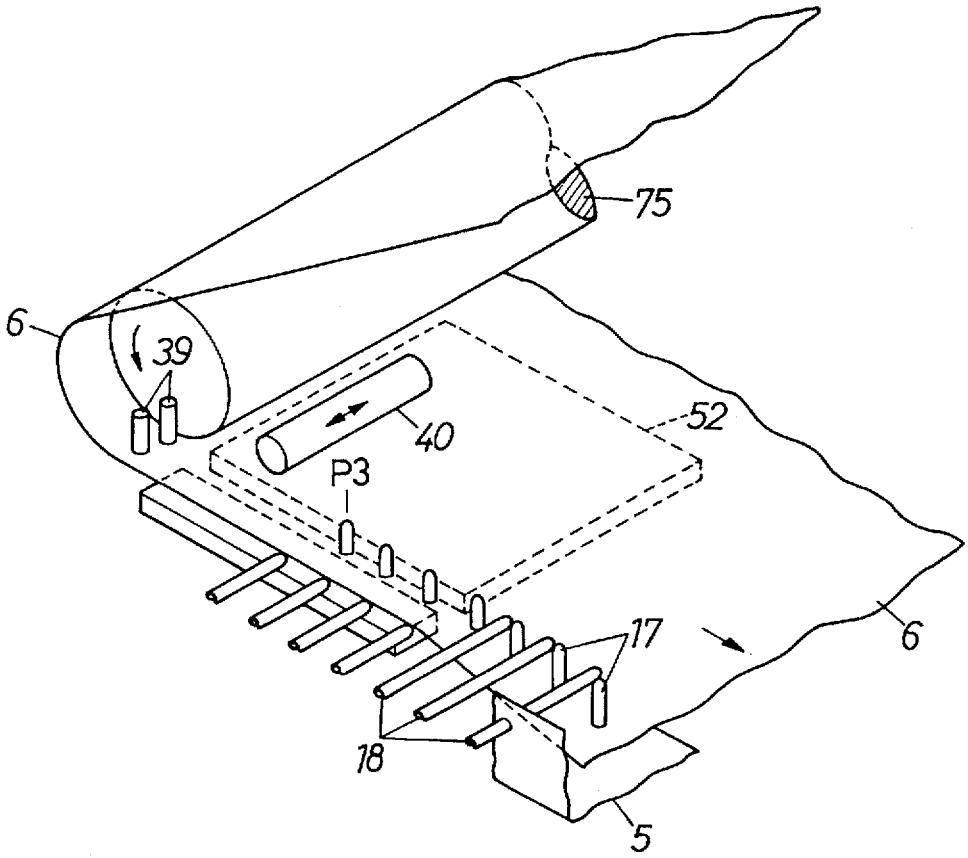
FIG. 16 is a perspective view showing the second knitted fabric hooked on the first and the second point needles on the automatic linking apparatus of FIG. 9.
Figure 17:
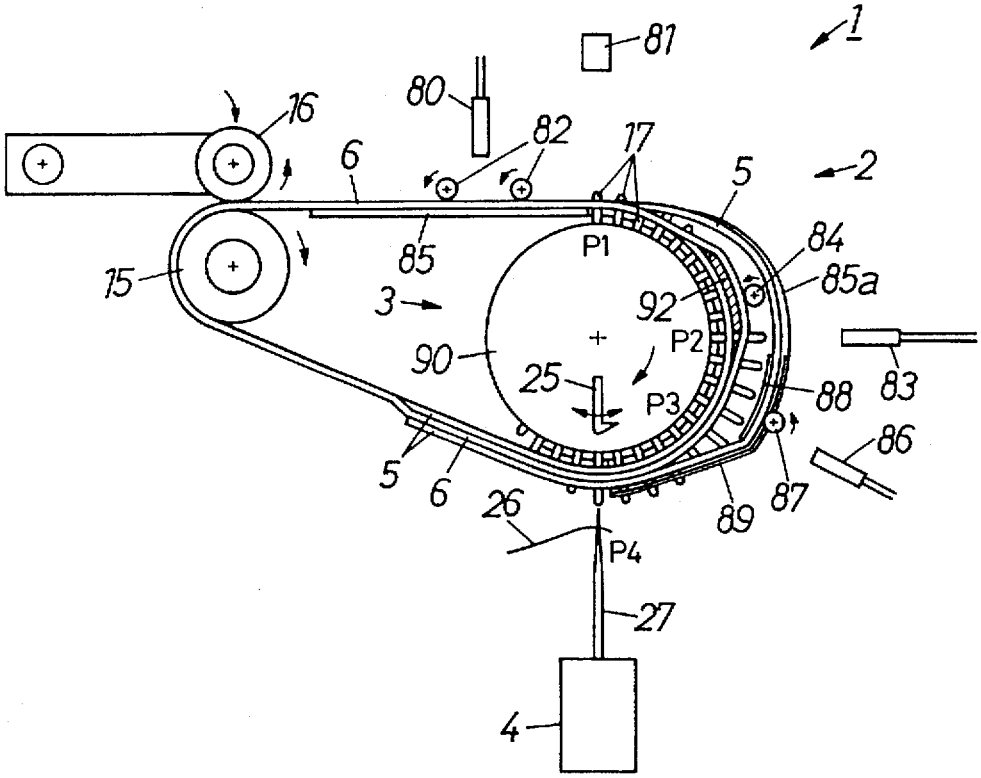
FIG. 17 is a schematic front view of an automatic linking apparatus for carrying out an automatic linking method in a third embodiment according to the present invention.
Figure 18:
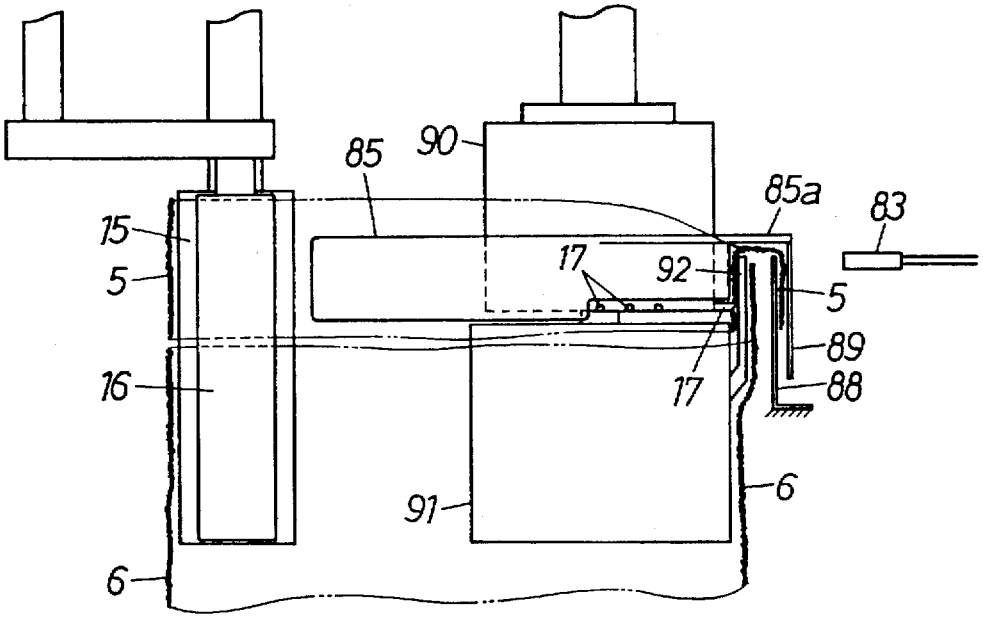
FIG. 18 is a schematic plan view of the automatic linking apparatus of FIG. 17.
Figure 19:
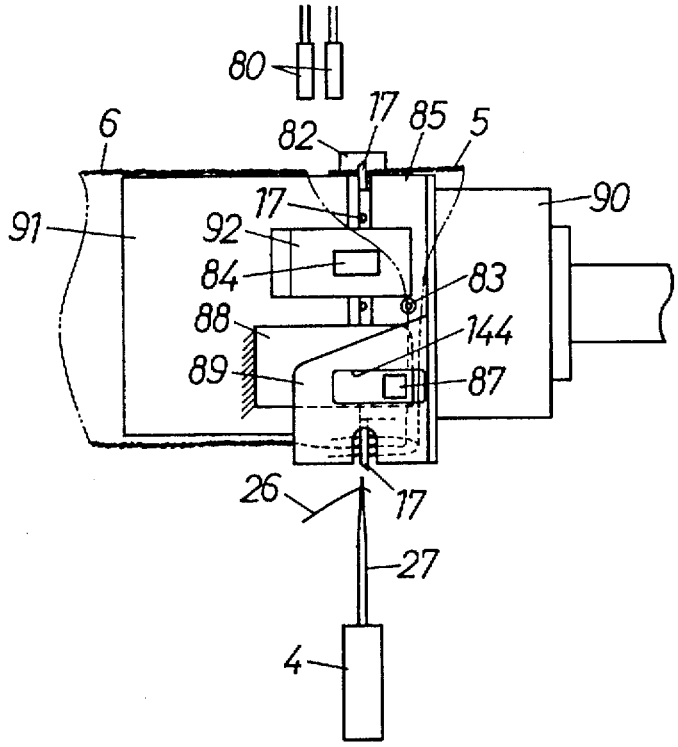
FIG. 19 is a schematic side view of the automatic linking apparatus of FIG. 17.
Figure 20:
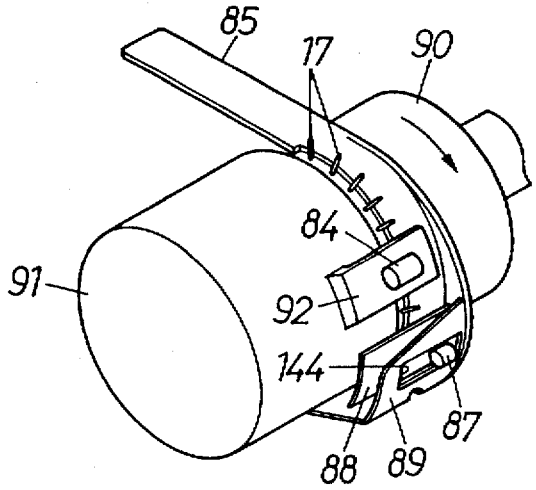
FIG. 20 is a schematic perspective view of a principal portion of the automatic linking apparatus of FIG. 17.
Figure 21:
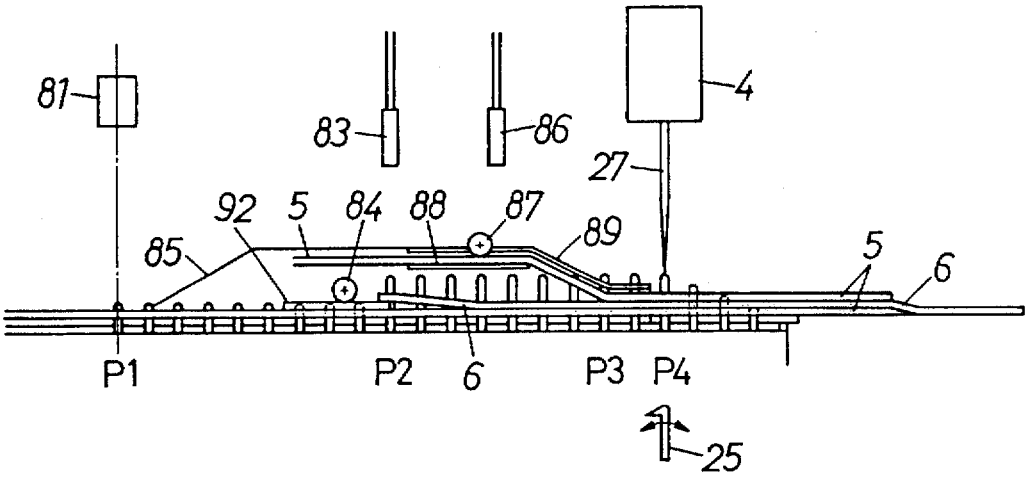
FIG. 21 is a development of first and second point needles on the automatic linking apparatus of FIG. 17.

FIGS. 12 to 16 illustrate steps to be executed sequentially to link up the first knitted fabric 5 and the second knitted fabric 6 as the same are fed in the fabric feed direction. In a step shown in FIG. 12, the first knitted fabric 5 is laid on the L-shaped table 42, and the first point needles 17 and the second point needles 18 are at their retracted positions. In a step shown in FIG. 13, the first point needles 17 set in a vertical position are raised at the first needling position P1 by the needle raising device 50 so as to be thrust into the expanded stitches of the horizontal first edge portion of the first knitted fabric 5, and the second point needles 18 set in a horizontal position are raised at the second needling position P2 by the needle raising device 56 so as to be thrust into the expanded stitches of the vertical second edge portion of the first knitted fabric 5. Then, as shown in FIGS. 14 and 16, the second knitted fabric 6 is hooked on the first point needles 17 raised by the higher cam section of the cam 51 in a blind needling mode so as to overlap the horizontal first edge portion of the first knitted fabric 5.

Then, as shown in FIGS. 15 and 16, the second point needles 18 are further raised by the needle raising device 57 to set the second point needles 18 point to point with the first point needles 17 for transfer operation. The vertical second edge portion of the first knitted fabric 5 is transferred from the horizontal second point needles 18 to the vertical first point needles 17 by the guiding action of the transfer guide plate 41 so as to be seated on the upper surface of the second knitted fabric 6. Thus, the edge portion of the second knitted fabric 6 is sandwiched between the first and the second edge portion of the first knitted fabric 5. In this state, the first knitted fabric 5 and the second knitted fabric 6 are linked up with the thread 26 by the cooperative actions of the needle 27 and the looper 25 of the sewing machine 4. The transfer guide plate 41, similarly to the guide plate 13 of the automatic linking apparatus for carrying out the first embodiment, has two inclined surfaces.

Third Embodiment

An automatic linking method in a third embodiment according to the present invention is carried out by an automatic linking apparatus 1 shown in FIGS. 17 to 22. This automatic linking apparatus 1 employs a fabric feed system substantially the same as that employed by the automatic linking apparatus 1 for carrying out the automatic linking method in the first embodiment to carry out sandwich linking. A needle moving unit 3 has only a single row of point needles, i.e., first point needles 17, supported on a rotary drum 19 at equal angular pitches for radial movement. The first point needles 17 are moved by a mechanism substantially the same as that employed in the automatic linking apparatus 1 for carrying out the automatic linking method in the first embodiment. A first needling position P1, a second needling position P2 and a third needling position P3 are set in the needle moving unit 3.

A fabric guide unit 2 has first, second and third fabric guide devices disposed at the needling positions P1, P2 and P3, respectively. The first fabric guide device for guiding a first edge portion of a first knitted fabric 5 to the needling position P1 comprises a pair of edge sensors 80, an image processing camera 81, two rollers 82 and a guide plate 85. The second fabric guide device for guiding an edge portion of a second knitted fabric 6 to the second needling position P2 comprises a pair of edge sensors 83, a roller 84 and a guide plate 92. The third fabric guide device for guiding a second edge portion of the first knitted fabric to the third needling position P3 comprises a pair of edge sensors 86, a roller 87 and two guide plates 88 and 89.

The guide plate 85 has a flat portion extending between a feed roller 15 and the first needling position P1 in a horizontal plane, a curved portion curved in a circular arc, and a vertical portion 85*a* extending from one side edge of the curved portion. The guide plate 89 is extended between the second needling position P2 to a stitching position P4 on the vertical portion 85*a* of the guide plate 85. The guide plate 89 has a curved portion curved in a circular arc and extending from the second needling position P2 in the fabric feed direction, and an inclined portion 50 as to approach the first point needles as the same extends in the fabric feed direction. The curved portion of the guide plate 89 is provided with an opening 144 through which the knitted fabric is exposed.

A slit is formed in the inclined portion of the guide plate 89 to avoid interference between the inclined portion and the tips of the first point needles 17. A curved guide plate 88 curved in a circular arc is inserted between the curved portion of the guide plate 89 and the first point needles 17. The roller 87 is supported on the outer surface of the guide plate 88 so as to be positioned in the opening 144, and the pair of edge sensors 86 are disposed at positions corresponding to the opening 144. A curved guide 92 curved in a circular arc is disposed above the second needling position P2 with respect to the fabric feed direction, and is attached to a cover 91.

An endless first knitted fabric 5 is guided by the guide plate 85 so that a first edge portion thereof can be hooked on the first point needles 17 at the first needling position P1, and a second edge portion thereof slides along the vertical portion 85*a* of the guide plate 85 and moves into a space between the guide plates 88 and 89 as the first knitted fabric 5 moves together with the first point needles 17 in the fabric feed direction. Consequently, the first knitted fabric 5 is bent in a U-shaped cross section and the second edge portion of the first knitted fabric 5 is positioned by the edge positioning agency of the edge sensors 86 and the roller 87.

An endless second knitted fabric 6 is fed by the rotation of the feed roller 15 and the movement of the first point needles 17 in the fabric feed direction, is positioned on the curved guide 92 by the agency of the pair of edge sensors 83 and the roller 84, and is hooked on the first point needles 17 raised for a second raising step at the second needling position P2. Subsequently, to the second edge portion of the first knitted fabric 5 is guided toward the first point needles 17 by the inclined portion of the outer guide plate 89 and is hooked on the first point needles at the third needling position P3. The lift of the first point needles 17 at the third needling position P3 is equal to the lift at the second needling position P2.

Thus, the first and the second edge portion of the first knitted fabric and the edge portion of the second knitted fabric 6 are hooked on the first point needles 17 of the needle moving unit 3. Then, the first and the second edge portion of the first knitted fabric 5 and the edge portion of the second knitted fabric 6 are stitched together by a sewing machine 4 at the stitching position P4.

Figure 22:
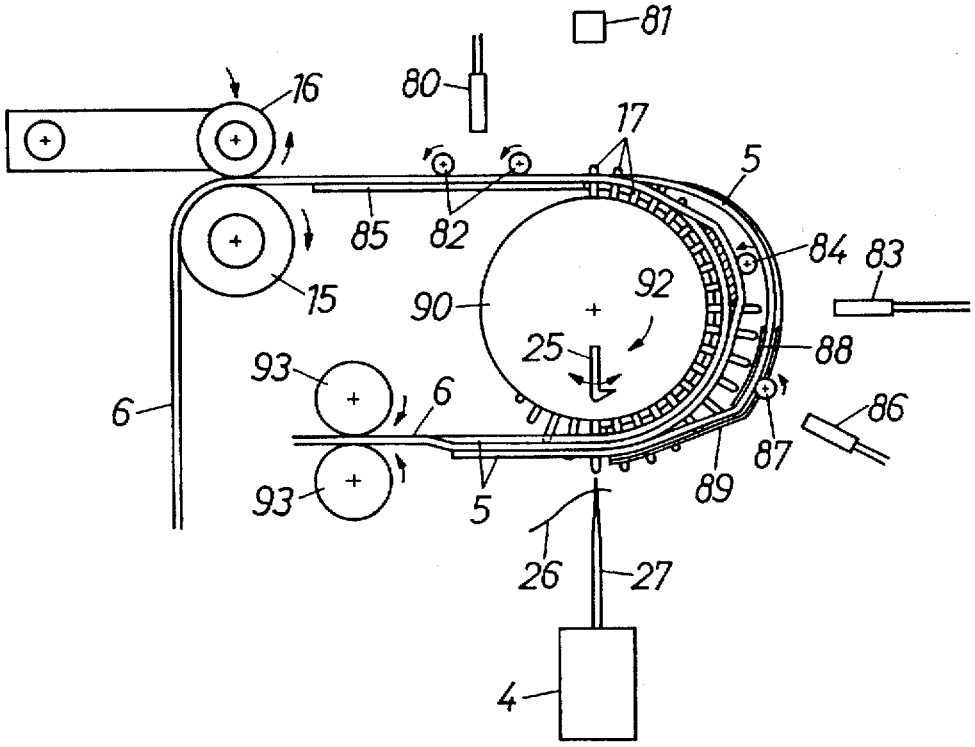
FIG. 22 is a front view of a modification of the automatic linking apparatus of FIG. 17.

When the second knitted fabric 6 is not an endless one but a flat one, the first knitted fabric 5 and the second knitted fabric 6 are pulled by a pair of delivery rollers 93 as shown in FIG. 22 after the same have been stitched together.

Fourth Embodiment

Figure 23:
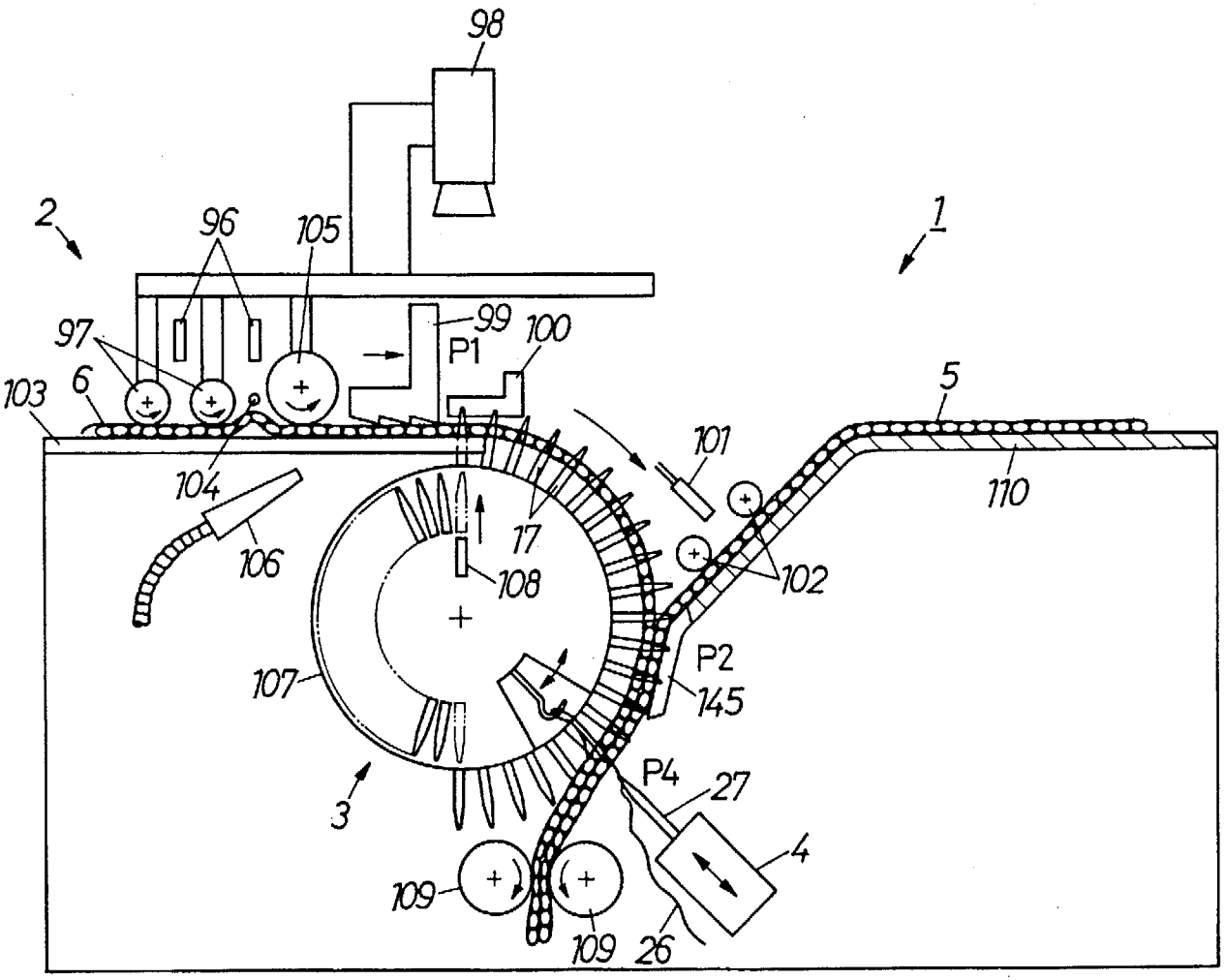
FIG. 23 is a schematic front view of an automatic linking apparatus for carrying out an automatic linking method in a fourth embodiment according to the present invention.

An automatic linking method in a fourth embodiment according to the present invention is carried out by an automatic linking apparatus 1 shown in FIG. 23. This automatic linking apparatus 1 is used for linking up two body parts, and for linking up a body part and an accessory part by single linking. A second knitted fabric 6, such as a body part, is hooked on first point needles 17 while an image of the second knitted fabric is processed for hooking up, a first knitted fabric 5, such as an accessory part, is positioned and hooked on the first point needles 17 without hooking up the same, and the first knitted fabric 5 and the second knitted fabric 6 are moved to a stitching position P4.

A needle moving unit 3 has the first point needles 17 arranged in a circle and to be moved along a circle. A first needling position P1 and a second needling position P2 are set in the needle moving unit 3. A fabric guide unit 2 has first and second fabric guide devices disposed at the first needling position P1 and the second needling position P2, respectively. The first fabric guide device for guiding the second knitted fabric 6 to the first needling position P1 comprises a pair of edge sensors 96, a plurality of rollers 97, an image processing camera 98, a pair of hands 99 and a pair of auxiliary hands 100. The second fabric guide device for guiding the first knitted fabric to the second needling position P2 comprises a pair of edge sensors 101 and two rollers 102.

The second knitted fabric 6 is placed on a table 103, and positioned with respect to a direction perpendicular to the fabric feed direction by the agency of the pair of edge sensors 96 of a two-step type and the positioning roller 97. A slack detector 104 detects a slack in the second knitted fabric 6, and a feed regulating roller 105 delivers the second knitted fabric 6 to a stitch indexing position.

The operations of the positioning rollers 97 and the feed regulating roller 105 will be described below. The positioning rollers 97 are supported for rotation so as to be axially movable in opposite directions by actuators, not shown. The positioning rollers 97 are moved axially according to edge detection signals to position the edge of the second knitted fabric 6 at a position corresponding to a position between the pair of edge sensors 96. The back positioning roller 97 is dragged for rotation by the moving second knitted fabric 6, and the front positioning roller 97 and the feed regulating roller 105 are driven positively for rotation by motors, not shown. The feed regulating roller 105, like the positioning rollers 97, is axially movable.

A slack detector 104 is disposed beside and slightly above the second knitted fabric 6. The front positioning roller 97 is rotated positively until the slack detector 104 detects the second knitted fabric 6, i.e., until a predetermined slack is formed in the second knitted fabric 6 above the back positioning roller 97. The feed regulating roller 105 rotates in synchronism with the feed operation of the pair of hands 99 for feeding the second knitted fabric 6 to feed a predetermined length of the second knitted fabric 6 at a time. The slack is pulled in by feeding the second knitted fabric 6 by the feed regulating roller 105 and, upon the detection of disappearance of the slack by the slack detector 104, the front positioning roller 97 resumes rotating to form a slack positively in the second knitted fabric 6. The feed regulating roller 105 is axially movable and moves axially according to command given thereto by an image processing unit when the dislocation of the second knitted fabric 6 from the correct position is detected by processing an image of the second knitted fabric 6 to correct the position of the second knitted fabric 6.

The camera 98 takes an image of the first knitted fabric 5 illuminated by a light source 106 and gives image data to an image processing unit, not shown. The image processing unit determines stitches of the second knitted fabric 6 to be stitched to the first knitted fabric 5 on the basis of the image data, and the pair of hands 99 stretches the second knitted fabric 6 to expand the stitches and positions the stitches to be stitched to the first knitted fabric 5 on the flat surface of the table 103. The second knitted fabric 6 thus positioned is held at the first needling position P1 by the pair of auxiliary hands 100.

A rotary drum 107 rotates in the direction of the arrow at a surface speed equal to a feed speed at which the second knitted fabric 6 is fed. The first point needles 17 arranged at predetermined pitches are raised at the first needling position P1 by operating a needle raising device 108 by a cam or an actuator, not shown, to thrust the first point needles in the expanded stitches of the second knitted fabric 6. The first point needles 17 turn together with the rotary drum 107 in the fabric feed direction to the stitching position P4.

The first knitted fabric 5 is positioned on a table 110 by the agency of the pair of edge sensors 101 and the rollers 102 and is hooked on the first point needles 17 at the second needling position P2. A slit 145 is formed in the lower end portion of the table 110. The lower end portion of the table 110, like the inclined surface of the guide plate 89 of the automatic linking apparatus 1 for carrying out the third embodiment, guides the first knitted fabric 5 so as to be hooked on the first point needles 17. The first knitted fabric 5 hooked on the point needles 17 is moved together with the first point needles 17 to the stitching position P4.

Thus, the first knitted fabric 5 and the second knitted fabric 6 are held on the first point needles 17, are stitched together by a sewing machine 4 at the stitching position P4, and are delivered by a pair of delivery rollers 109. The raised first point needles 17 are returned to a retracted position as the rotary drum 107 rotates by a cam or the like, not shown. This automatic linking apparatus 1 has a very simple construction. The second fabric guide device may be the same in construction as the first fabric guide device, which makes possible linking up two body parts respectively having curved linking lines.

Accessory Part Connecting Method

Figure 24:
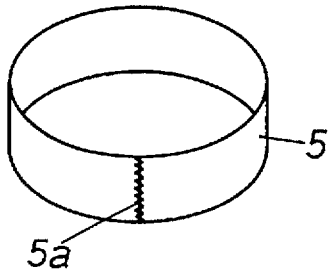
FIG. 24 is a perspective view of a ring-like first knitted fabric (accessory part)
Figure 25:
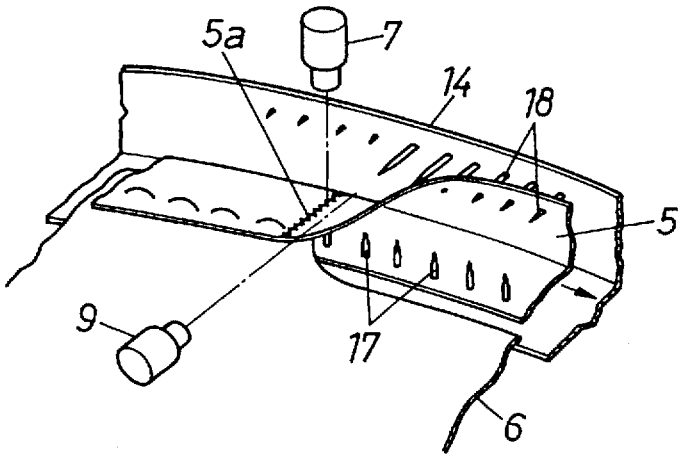
FIG. 25 is a perspective view for assistance in explaining a method of linking a second knitted fabric and a first knitted fabric sandwiching the second knitted fabric.
Figure 26:
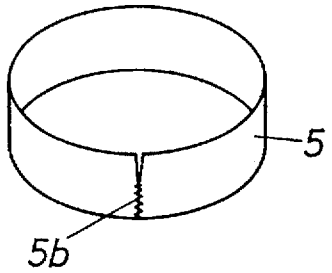
FIG. 26 is a perspective view of a ring-like first knitted fabric.

In the first and the third embodiment, the first knitted fabric 5, i.e., the accessory part, is formed in an endless shape having a joint **5*a* as shown in FIG. 24 by joining together the opposite shorter edges. In a state just before completing linking, i.e., a state where a portion first stitched to the second knitted fabric 6 approaches the needling position, as shown in FIG. 25, a portion of the first knitted fabric 5 not hooked on the point needles is bent making the detection of the first knitted fabric 5 (edge detection by the edge sensors 7, 9 and 80, and forming an image of the first knitted fabric 5 by the camera 81) difficult, so that it is difficult to guide the first knitted fabric 5 (stitch hooking up and edge positioning). A first knitted fabric 5 shown in FIG. 26 is formed in an endless shape by stitching together only the respective halves of the shorter edges of the first knitted fabric 5 to form a joint 5*b*. The needling operation is started from the joint 5*b* and is completed at the joint 5*b***.

Figure 27:
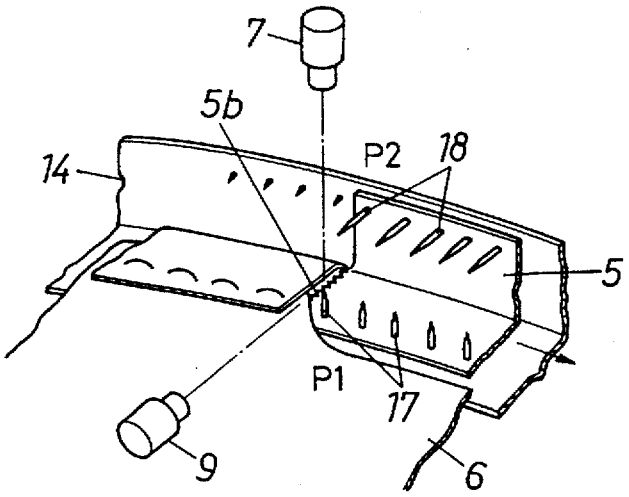
FIG. 27 is a perspective view for assistance in explaining a method of linking a second knitted fabric and a first knitted fabric sandwiching the second knitted fabric.

When stitching the first knitted fabric 5 shown in FIG. 26 to a second knitted fabric 6 by the first embodiment, the first stitch of the first edge portion of the first knitted fabric 5 is hooked on the first point needle 17 at the first needling position P1, the first stitch of the second edge portion of the first knitted fabric 5 on the second point needle 18 at the second needling position P2, and the edge portion of the second knitted fabric 6 is hooked on the first point needles 17 at the third needling position P3 by hand. Then, the automatic linking apparatus 1 is started to needle the first knitted fabric 5 and the second knitted fabric 6 as the same is fed automatically in the direction of the arrow. Since only portions of the shorter edges of the first knitted fabric 5, i.e., the accessory part, are stitched together, portions of the shorter edges not stitched together are not bent just before the completion of linking as shown in FIG. 27, so that the first knitted fabric 5 can be detected and can be guided without difficulty. It is desirable to suspend the operation of the sewing machine 4 until the first stitches of the first knitted fabric 5 and the second knitted fabric 6 arrive at the stitching position P4 to avoid useless stitching.

When stitching the first knitted fabric 5 shown in FIG. 26 to a second knitted fabric 6 by the third embodiment, the first stitch of the first edge portion of the first knitted fabric 5 is hooked on the first point needle 17 at the first needling position P1, and the edge portion of the second knitted fabric 6 is hooked on the first point needles 17 at the third needling position P3 by hand. Then, the automatic linking apparatus 1 is started for linking operation. Since only portions of the shorter edges of the first knitted fabric 5, i.e., the accessory part, are stitched together, portions of the shorter edges not stitched together are not bent just before the completion of linking, so that the first knitted fabric 5 can be detected and can be guided without difficulty.

Stitch Detecting Method

Figure 28:
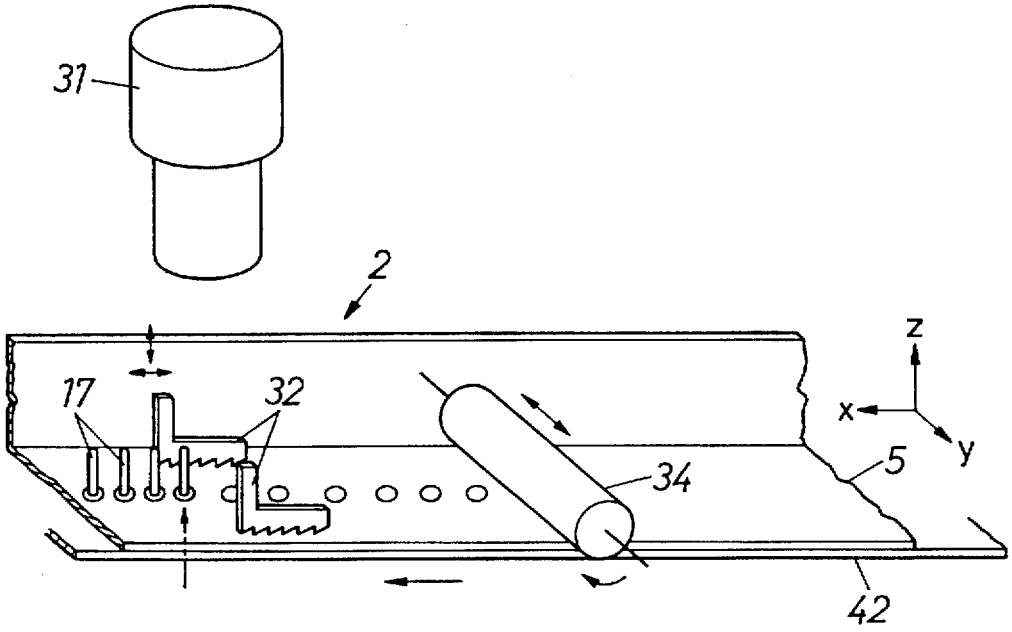
FIG. 28 is a schematic perspective view of a mechanism for stretching a knitted fabric in the X- and the Y-direction as the knitted fabric is fed in the feed direction.
Figure 29:
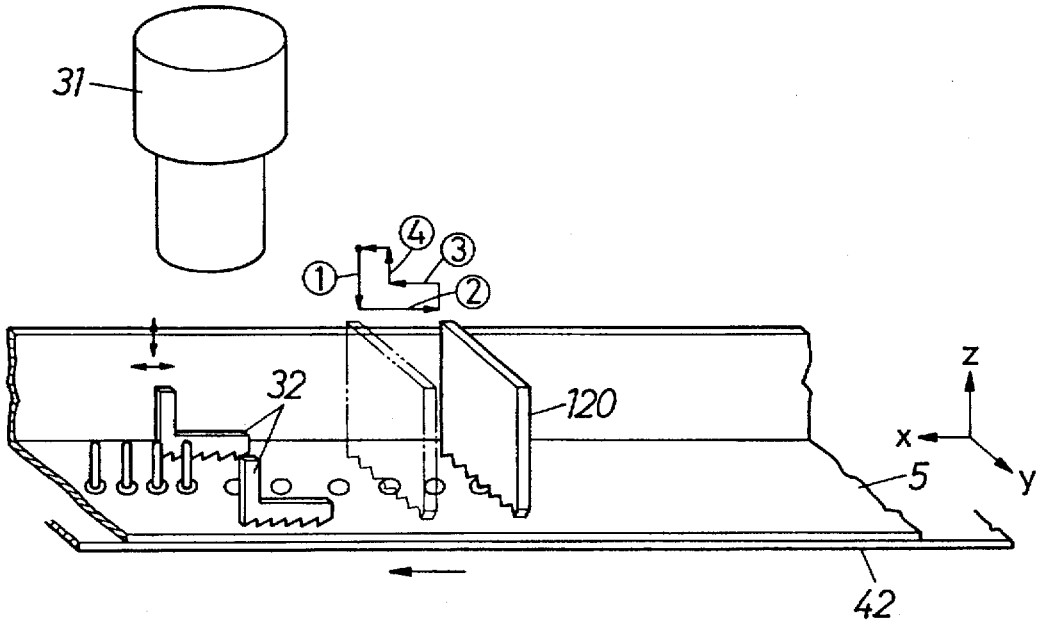
FIG. 29 is a schematic perspective view of a mechanism for stretching a knitted fabric in the X-direction as the knitted fabric is fed in the feed direction.

FIGS. 28 and 29 illustrate fabric stretching mechanisms for stretching the first knitted fabric 5 in the fabric feed direction when taking a clear image of the first knitted fabric 5 for stitch detection when carrying out the second embodiment. This stitch detecting method is particularly effective in detecting stitches of a rib-knitted fabric. The first knitted fabric 5 is stretched in a direction perpendicular to the fabric feed direction to expand the stitches so that the stitches can be easily detected.

Referring to FIG. 28, showing a fabric stretching mechanism to be applied to the fabric guide unit 2 of the automatic linking apparatus 1 for carrying out the second embodiment, a first knitted fabric 5 is stretched in an X-Y plane in a fabric feed direction (X-direction) and in a direction perpendicular to the fabric feed direction (Y-direction) to take an image of the first knitted fabric 5. The hands 32 are disposed above the first knitted fabric 5, and a roller 34 is rotated through a predetermined angle in a direction reverse to the fabric feed direction to stretch the first knitted fabric 5 in the X-direction between the roller 34 and the first point needle on which the first knitted fabric 5 is hooked. Then, the pair of hands 32 are lowered to hold the first knitted fabric on the table 42, and then the pair of hands 32 are moved away from each other to stretch the first knitted fabric 5 in the Y-direction. In this state, the camera 31 takes an image of the first knitted fabric 5, and processes the image to detect the next stitch.

Then, the pair of hands 32 are advanced by a predetermined distance and, at the same time, the roller 34 is rotated through a predetermined angle for fabric feed operation. After the first knitted fabric 5 has thus been fed or simultaneously with the feed of the first knitted fabric 5, the pair of hands 32 and the roller 34 holding the first knitted fabric 5 are moved in the Y-direction to move the next stitch to the first needling position P1. Then, the first point needle 17 is raised and thrust into the detected stitch. Subsequently, the pair of hands 32 are raised and moved in the X- and the Y-direction. Since the length of the first knitted fabric 5 fed by the rotation of the roller 34 is equal to that of the same fed by the advancement of the pair of hands 32, a portion of the first knitted fabric 5 between the roller 34 and the first point needle 17 remains stretched. Therefore, when the pair of hands 32 are raised and returned to their initial positions, an image of the first knitted fabric 5 is taken by the camera 31 without rotating the roller 34 in the reverse direction, and the image is processed to find the next stitch. The foregoing operation is repeated to move the next stitch to the first needling position P1. Since the stitches of the first knitted fabric 5 are thus expanded, the stitches can be easily detected by processing the image of the first knitted fabric 5.

When it is decided that the roller 34 reaches a position beyond a limit position if the roller 34 is moved by a distance determined through the detection of the next stitch by which the roller 34 is expected to be moved in the Y-direction to move the next stitch to the first needling position P1, the roller 34 is raised, is moved in the Y-direction to the initial position with respect to the Y-direction, and is lowered to replace the roller 34 at a new position. Since the first knitted fabric 5 contracts when the roller 34 is raised, the roller 34 is rotated in the reverse direction after the same has been replaced at the new position to stretch the first knitted fabric 5. Then, the foregoing operations are repeated to detect the next stitch.

Referring to FIG. 29, showing a fabric stretching mechanism employing, instead of the roller 34, a fabric stretching plate 120 having a saw-toothed working edge, a first knitted fabric 5 is stretched only in the X-direction. The fabric stretching plate 120 starts moving from an initial position in a direction 1 to hold the first knitted fabric 5 on the table 42, moves in a direction 2 to stretch the first knitted fabric 5 in the X-direction. In this state, the camera 31 takes an image of the first knitted fabric 5, processes the image and detects the next stitch. Both the fabric stretching plate 120 and the pair of hands 32 are moved in a direction 3 (advanced) by a distance corresponding to the dislocation of the detected next stitch from the first needling position P1 with respect to the X-direction, the pair of hands 32 and the fabric stretching plate 120 are moved in the Y-direction to position the detected stitch at the first needling position P1, and then the first point needle 17 is raised to be thrust into the stitch. Subsequently, the pair of hands 32 are raised in a direction 4 and are moved in the X- and the Y-direction to its initial position. The first knitted fabric 5 is stretched in the X-direction by the combined horizontal and vertical motions of the fabric stretching plate 120 to facilitate the recognition of stitches by image processing.

Although the foregoing embodiment stretches the first knitted fabric 5 only in the X-Y plane, the first knitted fabric 5 can be stretched also in an X-Z plane by using the roller 38, the pair of hands 36 and the pair of auxiliary hands **36*a* or providing a fabric stretching plate like the fabric stretching plate 120** on the X-Z plane.

Although the invention has been described in its preferred form with a certain degree of particularity, obviously many changes and variations are possible therein. It is therefore to be understood that the present invention may be practiced otherwise than as specifically described herein without departing from the scope and spirit thereof.

What is claimed is:

1. An automatic linking method that hooks linking portions of a plurality of knitted fabrics to be linked up on point needles and stitches together superposed linking portions of the knitted fabrics to be linked up, said automatic linking method comprising steps of:

detecting the position of a first knitted fabric and guiding a linking portion of the first knitted fabric to a first needling position by a fabric guide mechanism;

thrusting point needles sequentially into the linking portion of the first knitted fabric and moving the point needles in a direction in which the point needles are arranged;

detecting the position of a second knitted fabric and guiding a linking portion of the second knitted fabric by the fabric guide mechanism to a second needling position below the first needling position with respect to a direction in which the point needles are moved and on a level above the tips of the point needles;

moving the second knitted fabric at the second needling position in a direction in which the point needles are extended so that the point needles on which the linking portion of the first knitted fabric is hooked are thrust sequentially into the linking portion of the second knitted fabric to superpose the linking portions of the first and the second knitted fabric; and moving the point needles to move the first and the second knitted fabric hooked on the point needles to a stitching position below the second needling position with respect to the direction in which the point needles are moved, and stitching together the first and the second knitted fabric by a sewing machine for single linking.

2. An automatic linking method for stitching together superposed linking portions of two knitted fabrics, said method comprising:

arranging a plurality of point needles in two rows extending in a single direction, said point needles being movable downstream in said single direction, setting first and second needling positions respectively along the two rows of the point needles, and setting a third needling position along one of the two rows of the point needles downstream relative to the first needling position;

bending a first of the two knitted fabrics in an L-shape, and guiding the linking portions of two edges of the first knitted fabric to the first and second needling positions by a fabric guide mechanism while detecting the two edges of the first knitted fabric;

moving the point needles in the downstream direction after sequentially thrusting the point needles into the linking portions of the first knitted fabric after the first knitted fabric has been guided by the fabric guide mechanism;

guiding the linking portions of a second of the two knitted fabrics to the third needling position by the fabric guide mechanism while detecting the second knitted fabric;

sequentially thrusting point needles of one of the two rows of the point needles into the linking portion of the second knitted fabric after the second knitted fabric has been guided by the fabric guide mechanism;

transferring the linking portions of one of the two knitted fabrics, into which the point needles of one of the two rows have been thrust, toward the point needles of the other of the two rows by a knitted fabric moving mechanism after the two rows of point needles are set to confront each other at their tip ends, thereby sandwiching one of the knitted fabrics between edges of the other of the knitted fabrics such that the two knitted fabrics are superposed; and guiding the two superposed knitted fabrics by movement of the point needles to a stitching position downstream of the third needling position, and sewing the two superposed knitted fabrics together by a sewing machine.

3. An automatic linking method according to claim 2, wherein the two rows of the point needles are arranged in concentric circles, and one of the rows of the point needles is arranged so that the point needles thereof extend in a radial direction of the circles, and the other of the rows of point needles is provided outside the one of the rows of the point needles and so that point needles of the other of the rows of point needles extend in an axial direction of the circles.

4. An automatic linking method according to claim 2, wherein each of the two rows of the point needles comprises a linear row of the point needles, the point needles of one of the two rows extending at right angles relative to the point needles of the other of the two rows.

* * * * *